US009115488B2

(12) United States Patent
Jankovec

(10) Patent No.: US 9,115,488 B2
(45) Date of Patent: Aug. 25, 2015

(54) SUSPENDED CEILING GRID CLIP FOR SECURING AN UNOPPOSED CROSS TEE TO A MAIN RUNNER

(71) Applicant: CHICAGO METALLIC COMPANY LLC, Chicago, IL (US)

(72) Inventor: Scott G. Jankovec, Elmhurst, IL (US)

(73) Assignee: Rockwool International A/S, Hedehusene (DK)

( * ) Notice: Subject to any disclaimer, the term of this patent is extended or adjusted under 35 U.S.C. 154(b) by 0 days.

(21) Appl. No.: 14/529,287

(22) Filed: Oct. 31, 2014

(65) Prior Publication Data

US 2015/0197937 A1 Jul. 16, 2015

Related U.S. Application Data

(60) Provisional application No. 61/928,078, filed on Jan. 16, 2014.

(51) Int. Cl.

| | |
|---|---|
| ***E04B 9/12*** | (2006.01) |
| ***E04B 9/30*** | (2006.01) |
| ***E04B 9/06*** | (2006.01) |

(52) U.S. Cl.

CPC ..... *E04B 9/127* (2013.01); *E04B 9/068* (2013.01); *E04B 9/122* (2013.01); *E04B 9/30* (2013.01)

(58) Field of Classification Search

CPC ..... E04B 9/30; E04B 9/18; E04B 9/122; E04B 9/127; E04B 9/067; E04B 9/10; E04B 2000/2415

USPC ..... 52/712, 665, 220.8, 506.05–506.07, 52/664; 248/316.7

See application file for complete search history.

(56) References Cited

U.S. PATENT DOCUMENTS

| | | | | |
|---|---|---|---|---|
| 3,213,979 | A * | 10/1965 | Oiler | 403/219 |
| 4,108,563 | A * | 8/1978 | Brown et al. | 403/347 |
| 4,161,856 | A | 7/1979 | Brown et al. | |
| 4,317,641 | A | 3/1982 | Sauer | |

(Continued)

FOREIGN PATENT DOCUMENTS

GB 1380742 A 1/1975

OTHER PUBLICATIONS

Patent Cooperation Treaty, from the International Search Authority, International Search Report for International Application No. PCT/US2014/063303, Applicant: Chicago Metallic Company LLC completed on Jan. 26, 2015, mailed Jan. 30, 2015.

(Continued)

*Primary Examiner* — Elizabeth A Plummer
*Assistant Examiner* — Kyle Walraed-Sullivan
(74) *Attorney, Agent, or Firm* — Cook Alex Ltd.

(57) ABSTRACT

A clip is provided for securing a cross tee to a main runner in a suspended ceiling grid system. The clip comprises a first leg configured to extend through the slot in the web of the main runner so as to lie alongside the web of a cross tee whose connector extends through the slot in a direction opposite to that of the first leg; a second leg extending generally perpendicularly to the first leg so as to lie alongside the web of the main runner; and a third leg extending generally perpendicularly to the second leg and generally parallel to the first leg. The third leg is sized to extend through an aperture in the web of the main runner and then be bent to lie alongside the web of the main runner on a side opposite to that of the second leg.

16 Claims, 4 Drawing Sheets

(56) References Cited

U.S. PATENT DOCUMENTS

| | | | | | |
|---|---|---|---|---|---|
| 4,479,341 | A | | 10/1984 | Schuplin | |
| 4,494,350 | A | | 1/1985 | Sharp | |
| 4,523,413 | A | * | 6/1985 | Koppenberg | 52/139 |
| 4,535,580 | A | | 8/1985 | Shirey | |
| 4,610,562 | A | * | 9/1986 | Dunn | 403/233 |
| 4,630,423 | A | * | 12/1986 | Lind | 52/506.06 |
| 4,715,161 | A | * | 12/1987 | Carraro et al. | 52/714 |
| 4,779,394 | A | | 10/1988 | Shirey et al. | |
| 5,044,138 | A | * | 9/1991 | Zaccardelli et al. | 52/667 |
| 5,046,294 | A | * | 9/1991 | Platt | 52/506.06 |
| 5,149,221 | A | * | 9/1992 | Slapsys | 403/201 |
| 5,154,031 | A | | 10/1992 | Wall | |
| 5,216,865 | A | | 6/1993 | LaLonde et al. | |
| 5,551,792 | A | | 9/1996 | Witmyer | |
| 5,572,844 | A | | 11/1996 | Stackenwalt et al. | |
| D387,970 | S | * | 12/1997 | Enslen | D8/349 |
| 5,699,641 | A | | 12/1997 | Tinen et al. | |
| 5,822,941 | A | * | 10/1998 | Kinsella | 52/506.05 |
| 5,839,246 | A | | 11/1998 | Ziegler et al. | |
| 5,857,306 | A | | 1/1999 | Pellock | |
| D407,010 | S | * | 3/1999 | Sobczynski | D8/354 |
| 5,937,605 | A | * | 8/1999 | Wendt | 52/506.06 |
| 5,966,893 | A | * | 10/1999 | Quillin | 52/713 |
| 6,018,923 | A | * | 2/2000 | Wendt | 52/712 |
| 6,061,989 | A | * | 5/2000 | Trivedi et al. | 52/633 |
| 6,334,285 | B1 | * | 1/2002 | Kirschner | 52/702 |
| 7,293,393 | B2 | * | 11/2007 | Kelly et al. | 52/665 |
| D574,222 | S | * | 8/2008 | Golias et al. | D8/349 |
| 7,552,567 | B2 | | 6/2009 | Ingratta et al. | |
| D612,224 | S | * | 3/2010 | Wendt | D8/354 |
| 7,797,902 | B2 | * | 9/2010 | Hikai et al. | 52/506.05 |
| 7,930,864 | B2 | * | 4/2011 | Wendt | 52/712 |
| D637,898 | S | | 5/2011 | Tedesco et al. | |
| D638,287 | S | * | 5/2011 | Tedesco et al. | D8/394 |
| D649,016 | S | * | 11/2011 | Rasmussen | D8/354 |
| D654,350 | S | * | 2/2012 | Preda | D8/354 |
| D662,404 | S | | 6/2012 | Zhang et al. | |
| D662,405 | S | | 6/2012 | Zhang et al. | |
| D662,406 | S | | 6/2012 | Zhang et al. | |
| D662,809 | S | | 7/2012 | Zhang et al. | |
| D667,718 | S | * | 9/2012 | Preda | D8/354 |
| 8,413,402 | B2 | | 4/2013 | Sareyka | |
| 8,453,407 | B2 | * | 6/2013 | Tedesco et al. | 52/506.06 |
| 8,511,028 | B2 | * | 8/2013 | Lehane, Jr. | 52/506.07 |
| 8,584,418 | B2 | | 11/2013 | Underkofler et al. | |
| 8,813,457 | B2 | * | 8/2014 | Underkofler et al. | 52/712 |
| 8,820,026 | B2 | * | 9/2014 | Underkofler et al. | 52/712 |
| 8,839,583 | B2 | | 9/2014 | Sareyka et al. | |
| 2001/0032433 | A1 | | 10/2001 | Harris | |
| 2005/0160696 | A1 | * | 7/2005 | Kelly et al. | 52/712 |
| 2008/0163581 | A1 | * | 7/2008 | Greth | 52/702 |
| 2010/0095627 | A1 | * | 4/2010 | Meres et al. | 52/506.07 |
| 2010/0199594 | A1 | * | 8/2010 | Wendt | 52/718.04 |
| 2011/0131913 | A1 | | 6/2011 | Lehane | |
| 2011/0146184 | A1 | * | 6/2011 | Lehane, Jr. | 52/506.07 |
| 2011/0283634 | A1 | | 11/2011 | Underkofler et al. | |
| 2013/0205689 | A1 | * | 8/2013 | Lillette et al. | 52/167.1 |
| 2013/0227908 | A1 | * | 9/2013 | Gulbrandsen et al. | 52/665 |
| 2014/0000205 | A1 | | 1/2014 | Underkofler et al. | |
| 2014/0037366 | A1 | * | 2/2014 | Groza et al. | 403/171 |
| 2014/0069041 | A1 | | 3/2014 | Sareyka et al. | |

OTHER PUBLICATIONS

Patent Cooperation Treaty, from the International Search Authority, Written Opinion of the International Searching Authority for International Application No. PCT/US2014/063303, Applicant: Chicago Metallic Company LLC completed on Jan. 26, 2015, mailed Jan. 30, 2015.

* cited by examiner

SUSPENDED CEILING GRID CLIP FOR SECURING AN UNOPPOSED CROSS TEE TO A MAIN RUNNER

BACKGROUND

A typical suspended ceiling support grid comprises a series of elongated parallel main runners interconnected by cross tees to form rectangular cells for the receipt of ceiling panels, light fixtures, etc. The main runners and cross tees are roll formed from sheet metal so as to have a generally inverted T-shaped configuration, with a central web interposed between opposed flanges (for support of the edges of the ceiling panels and fixtures) and a strengthening bulb. The central web includes a series of slots and apertures for receiving connectors of associated runners and tees and hanger wires for suspending the grid system.

The grid system may be formed with the cross tees being collinear and extending from the associated main runner in opposition to one another, so that the cells in adjacent portions of the grid system are aligned. In such circumstances, the connectors on the ends of the cross tees extend through a slot on the main runner, and mate or interconnect with the connector on the opposed cross tee to secure the cross tees to the main runner.

Alternatively, the grid system may be formed with the cross tees extending from the main runners unopposed to another cross tee, such that the cells in adjacent portions of the grid system are staggered. The present application is directed to a clip that may be used to secure a cross tee to a main runner in the absence of an opposing cross tee.

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In a first aspect, a clip is provided for securing a cross tee to a main runner in a suspended ceiling grid system, in which the cross tee and the main runner both have a generally inverted T-shaped configuration with a vertical web interposed between opposed flanges and a strengthening bulb. The cross tee further includes a connector on at least one end thereof extending from the vertical web, and the vertical web of the main runner includes at least one generally vertical slot configured to receive the connector of the cross tee therethrough.

The clip comprises a first leg configured to extend through the slot in the web of the main runner so as to lie alongside the web of a cross tee whose connector extends through the slot in a direction opposite to that of the first leg. The clip further includes a second leg extending generally perpendicularly to the first leg so as to lie alongside the web of the main runner, and a third leg extending generally perpendicularly to the second leg and generally parallel to the first leg. The third leg is sized to extend through an aperture in the web of the main runner and then be bent to lie alongside the web of the main runner on a side opposite to that of the second leg. At least one of the first leg and the second leg has one or more apertures for facilitating securement of the first leg to the cross tee and the second leg to the main runner. Such securement may be by way of a screw, rivet or similar fastener.

In another aspect, the first leg of the clip comprises a first aperture configured to receive a raised surface on the connector of the cross tee so as to positively locate the first leg relative to the cross tee and a second aperture configured to receive a separate fastener for securing the cross tee to the first leg.

In a further aspect, the second leg comprises an aperture configured to receive a fastener for securing the main runner to the second leg.

In another aspect, the first leg comprises a third aperture configured to receive a fastener for securing the cross tee to the first leg.

In a further aspect, the third leg is weakened proximate to the second leg so as to facilitate bending. Preferably, the third leg is weakened by at least one notch, with the notch being configured to receive an edge of the aperture in the web of the main runner.

DETAILED DESCRIPTION OF THE EMBODIMENTS

Figure 1:
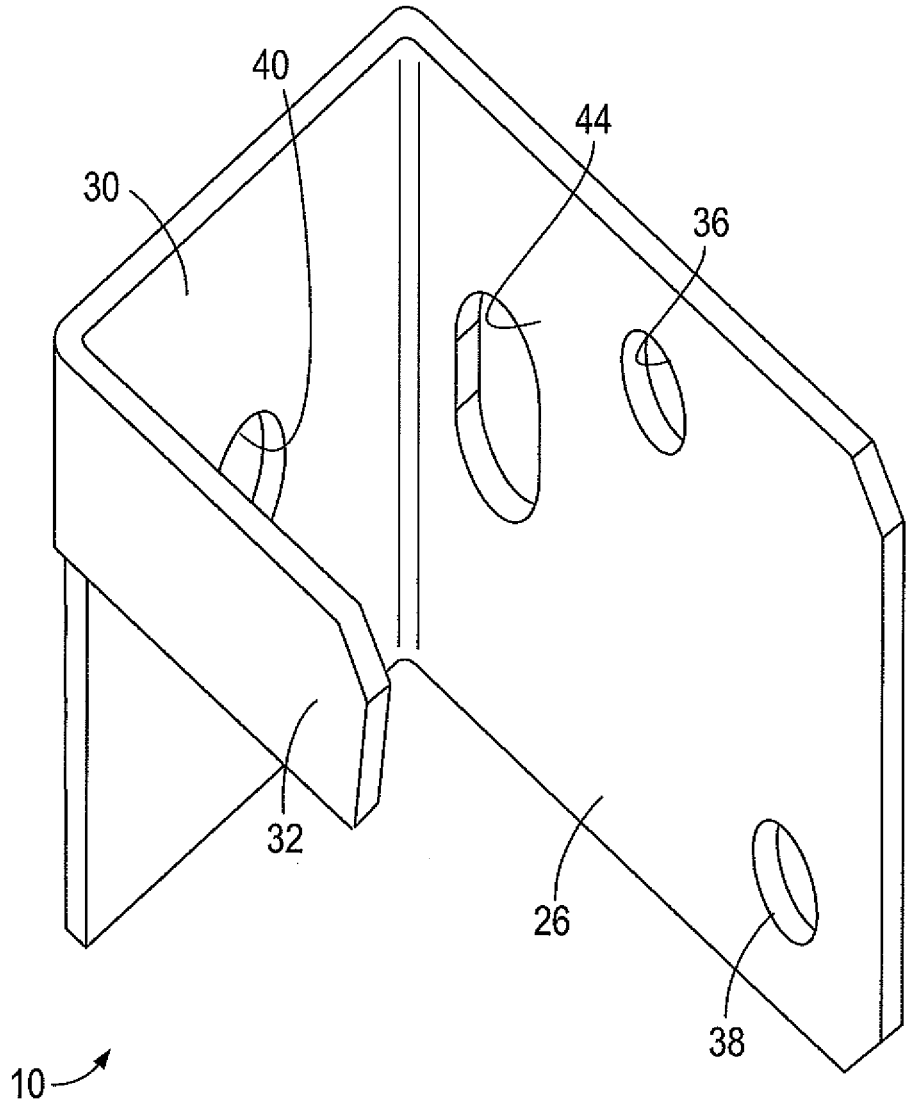
FIG. 1 is a perspective view of a first embodiment of a clip for securing an unopposed cross tee to a main runner in accordance with the present disclosure.

With reference to the drawings, a clip 10 is provided for securing an unopposed cross tee 12 to a main runner 14 in a suspended ceiling grid system. As is well known in the art, the cross tee 12 and the main runner 14 both having a generally inverted T-shaped configuration, with a vertical web 16 interposed between opposed flanges 18 and a strengthening bulb 20. The cross tee 12 also includes an end tab or connector 22 on at least one end thereof extending from its vertical web 16*a*. In addition, the vertical web 16*b* of the main runner 14 includes one or more generally vertical slots 24 configured to receive the connector 22 of a cross tee.

The clip 10 is preferably formed from sheet metal in a stamping operation and includes a first leg 26 configured to extend through the slot 24 in the web 16*b* of the main runner 14 so as to lie alongside the web 16*a* of a cross tee 12 whose connector 22 extends through the slot 24 in a direction opposite to that of the first leg 26. More particularly, the first leg 26 is sized to be received in a recess 28 formed in the web 16*b* of the main runner 14 that would otherwise receive the connector of an opposed cross tee, and thus preferably has approximately the same vertical and horizontal dimensions as the connector 22.

A second leg 30 extends generally perpendicularly to the first leg 26 so as to lie alongside the web 16*b* of the main runner 14. As shown, the second leg 30 has the same vertical dimension as the first leg 26. However, the vertical dimension could be larger, as the second leg 30 is not required to fit through the slot 24 of the main runner 14.

Figure 5:
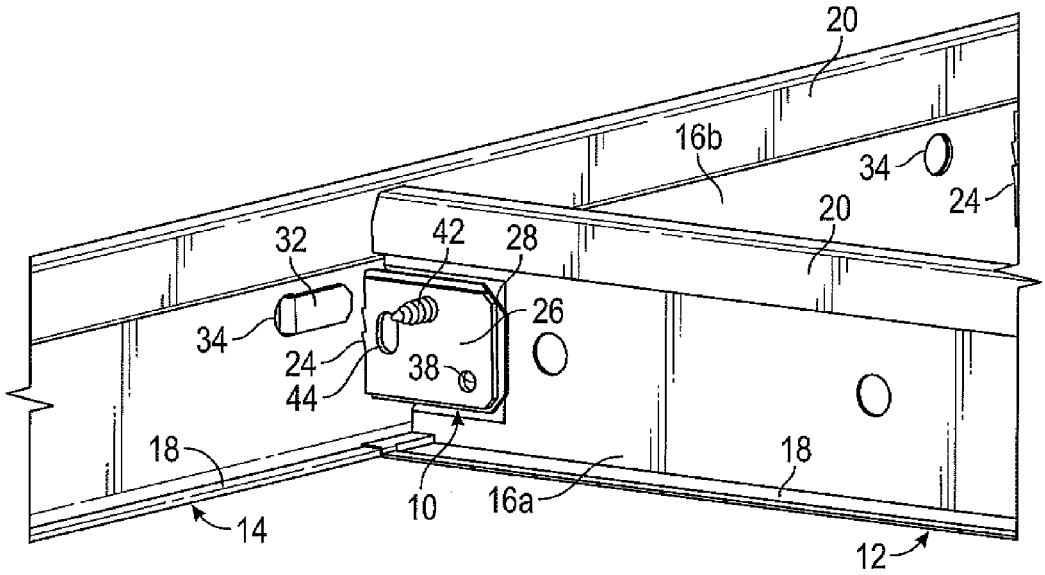
FIG. 5 is a perspective view showing one of the legs of the clip of FIG. 1 having been bent after installation to lie alongside the web of the main runner.

A third leg 32 extends generally perpendicularly to the second leg 30 and generally parallel to the first leg 26. The third leg 32 is sized to extend through an aperture 34 in the web 16*b* of the main runner 14, after which it can be bent to lie alongside the web 16*b* of the main runner 14 on the side opposite to that which the second leg 30 lies along, as shown in FIG. 5. Such bending of the third leg 32 holds the clip 10 in place on the main runner 14 during attachment of the cross tee 12. As illustrated, the third leg 32 is smaller than the first leg 26, so that it may extend through the aperture 34 that is provided in the main runner 14 for receipt of a hanger wire.

At least one, and preferably both, of the first leg 26 and the second leg 30 have one or more apertures for facilitating securement of the first leg 26 to the cross tee 12 and the second leg 30 to the main runner 14. As shown, the first leg 26 includes apertures 36 and 38, while the second leg includes aperture 40. Apertures 36 and 38 substantially align with apertures on the webs of the cross tee and form pilot holes that may receive a fastener, such as the screw 42 seen in FIGS. 2 and 5, that secures the first leg 26 to the cross tee 12. Other fasteners may be used, such as pop rivets, to secure the clip 10 to the main runner 14 and cross tee 12. It is contemplated that at least one such fastener will be used to maintain the connection between the cross tee 12 and the main runner 14 in areas of high seismic activity.

After securement of the clip 10 to the main runner 14 and the cross tee 12, the end tab or connector 22 of the cross tee 12 may be bent toward the web 16*b* of the main runner 14 to reduce the likelihood of the connector 22 interfering with the edge of a panel or light fixture to be supported on the flange 18 of the main runner 14.

Figure 2:
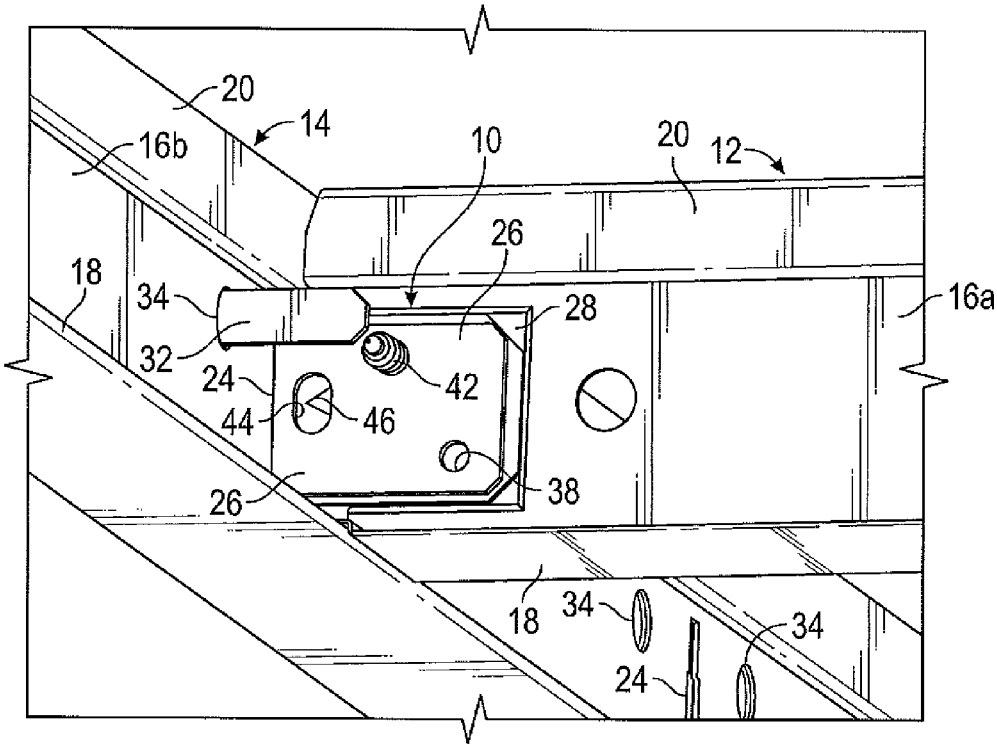
FIG. 2 is a perspective view of the clip shown in FIG. 1 in combination with a main runner and a cross tee.
Figure 3:
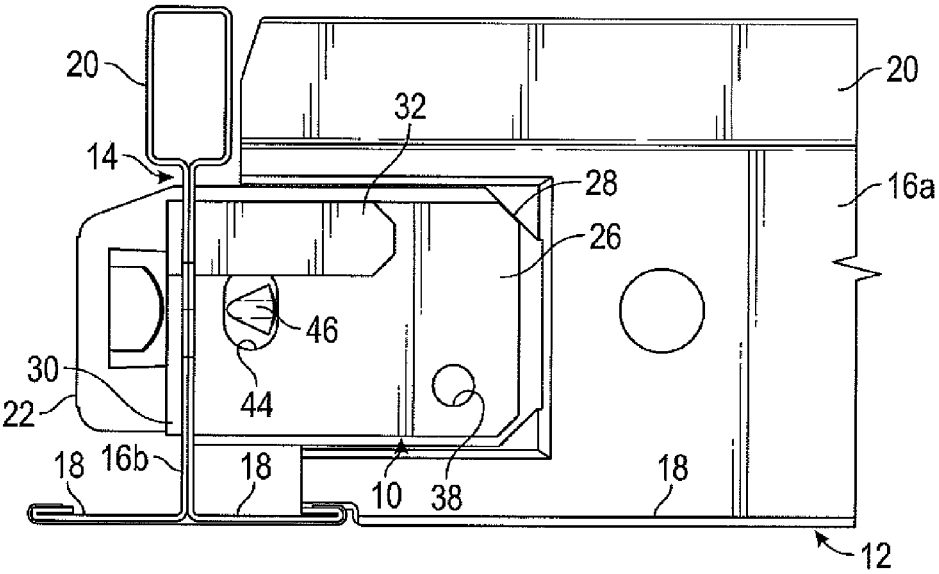
FIG. 3 is a side view of the clip, main runner and cross tee combination of FIG. 2.
Figure 4:
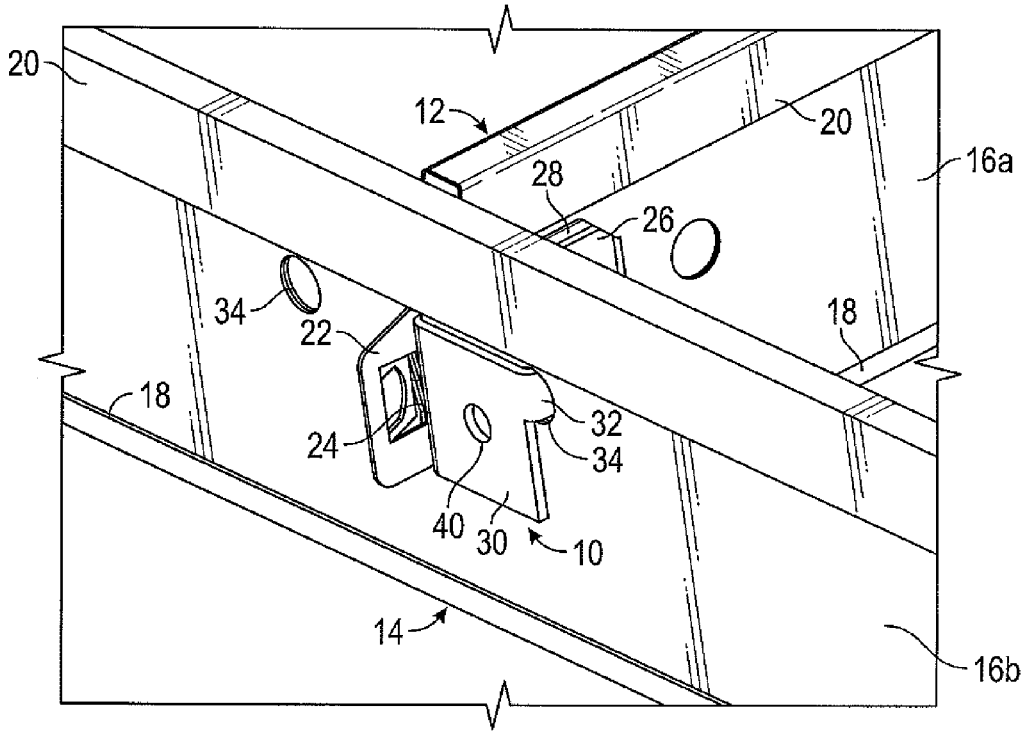
FIG. 4 is a further perspective view of the clip shown in FIG. 1 in combination with a main runner and a cross tee.

The first leg 26 also preferably includes an aperture 44 configured to receive an embossment formed on the connector 22 of the cross tee 12, such as the pyramid 46, best seen in FIGS. 2 and 3, to resist the separation of the cross tee from the main runner 14, particularly in the absence of some other securement means.

Figure 6:
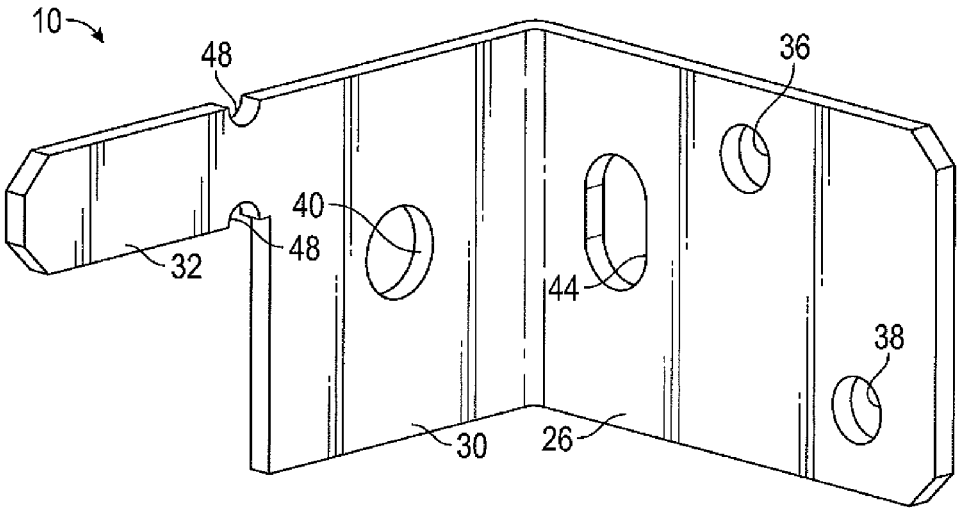
FIGS. 6 and 7 are perspective views of a second embodiment of a clip for securing an unopposed cross tee to a main runner in accordance with the present disclosure.
Figure 7:
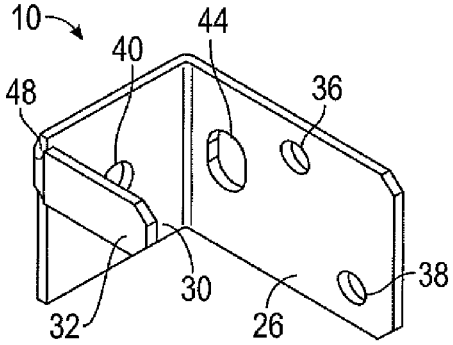
Figure 8:
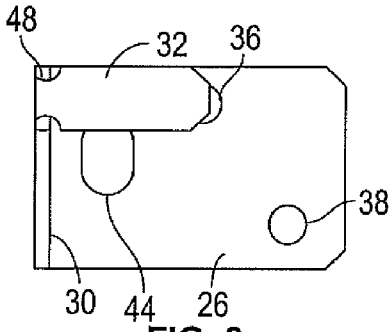
FIGS. 8-11 are front, right-hand side, back and top views, respectively, of the clip shown in FIG. 7.
Figure 9:
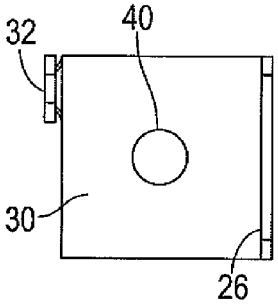
Figure 10:
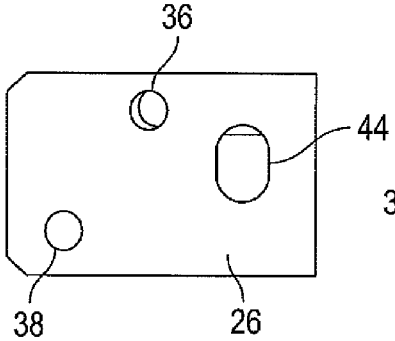
Figure 11:
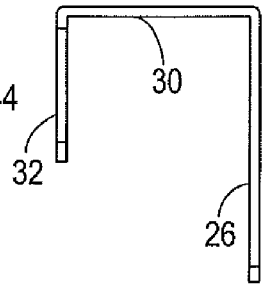

Turning to FIGS. 6-11, there is seen an alternate embodiment of a clip 10 for securing an unopposed cross tee to a main runner. The clip of FIGS. 6-11 differs from that of FIGS. 1-5 in that the third leg 32 is initially coplanar with the second leg 30 (as seen in FIG. 6), so that for installation, the third leg 32 is first bent (as seen in FIGS. 7-11) so as to be generally perpendicular to the second leg 30 to facilitate its insertion through the aperture 34 in the web 16*b* of the main runner 14, and then bent again to lie alongside the web 16*b* of the main runner 14 on the side opposite to that which the second leg 30 lies along, as shown in FIG. 5 with respect to the first embodiment of the clip 10.

Preferably, the third leg 32 is weakened to facilitate its bending at the desired location. As illustrated, this may be accomplished by providing the third leg 32 with one or more notches 48 at the bending location proximate to the second leg 30. Two semi-circular notches 32 are shown, although the notches may have other configurations, such as rectangular. Alternatively, the third leg 32 may be weakened at the desired location by other techniques known in the art, such as by scoring the surface of the third leg on one or both sides. Notches provide a particular advantage by allowing the edge of the aperture 34 to seat in the notches 48 to more positively locate and secure the clip 10 to the main runner 14 during assembly.

While described in the context of connecting a cross tee to a main runner, it should be appreciated that the clip described and claimed herein may also be used to connect a cross tee to another cross tee. Thus, for the purposes of this disclosure "main runner" is inclusive of both a main runner and a cross tee, as these terms are conventionally understood.

The invention claimed is:

1. A system comprising a clip for securing a cross tee to a main runner in a suspended ceiling grid system, the cross tee and the main runner both having a generally inverted T-shaped configuration with a vertical web interposed between opposed flanges and a strengthening bulb, the cross tee including a connector on at least one end thereof extending from the vertical web and the vertical web of the main runner including at least one generally vertical slot configured to receive the connector of the cross tee therethrough, the clip comprising:

a first leg having a vertical dimension and a free end with beveled corners configured to extend through the slot in the web of the main runner so as to lie alongside the web of a cross tee whose connector extends through the slot in a direction opposite to that of the first leg;

a second leg have a vertical dimension and extending from, and generally perpendicularly to, the first leg so as to lie alongside the web of the main runner; and a third leg having a vertical dimension less than the vertical dimensions of the first and second legs and extending from, and generally perpendicularly to, the second leg and lying in a plane generally parallel to a plane defined by the first leg so that the first, second and third legs define a generally U-shaped configuration for the clip, the third leg having a free end with beveled corners and sized to extend through an aperture in the web of the main runner and then be bent to lie alongside the web of the main runner on a side opposite to that of the second leg;

at least one of the first leg and the second leg having one or more apertures for facilitating securement of the first leg to the cross tee and the second leg to the main runner.

2. The clip of claim 1 wherein the first leg comprises a first aperture configured to receive a raised surface on the connector of the cross tee so as to positively locate the first leg relative to the cross tee and a second aperture configured to receive a separate fastener for securing the cross tee to the first leg.

3. The clip of claim 1 wherein the second leg comprises an aperture configured to receive a fastener for securing the main runner to the second leg.

4. The clip of claim 2 wherein the first leg comprises a third aperture configured to receive a fastener for securing the cross tee to the first leg.

5. The clip of claim 1 wherein the third leg is weakened proximate to the second leg so as to facilitate bending.

6. The clip of claim 5 wherein the third leg is weakened by at least one notch.

7. The clip of claim 6 wherein the notch is configured to receive an edge of the aperture in the web of the main runner.

8. A suspended ceiling grid system comprising:

a first cross tee;

a main runner, the first cross tee and the main runner both having a generally inverted T-shaped configuration with a vertical web interposed between opposed flanges and a strengthening bulb, the first cross tee including a connector on at least one end thereof extending from the vertical web and the vertical web of the main runner including at least one generally vertical slot configured to receive the connector of the first cross tee therethrough; and a clip for securing the first cross tee to a main runner, the clip comprising a first leg extending through the slot in the web of the main runner so as to lie alongside the web of the first cross tee, the connector of the first cross tee extending through the slot in a direction opposite to that of the first leg, a second leg extending from, and generally perpendicularly to the first leg lying along a first side of the web of the main runner, and a third leg extending from, and generally perpendicularly to, the second leg and generally parallel to the first leg so that the first, second and third legs define a generally U-shaped configuration for the clip, the third leg extending through an aperture in the web of the main runner and bendable relative to the second leg so as to lie along a second side of the web of the main runner on a side opposite to that of the second leg, at least one of the first leg and the second leg having one or more apertures for facilitating securement of the first leg to the first cross tee and the second leg to the main runner; and the first cross tee extending from the second side of the web of the main runner and being unopposed by a second cross tee aligned with the first cross tee extending from the first side of the web of the main runner.

9. The grid system of claim 8 wherein the first leg of the clip further comprises a first aperture configured to receive a raised surface on the connector of the first cross tee so as to positively locate the first leg relative to the first cross tee and a second aperture configured to receive a separate fastener for securing the first cross tee to the first leg.

10. The grid system of claim 8 wherein the second leg of the clip further comprises an aperture configured to receive a fastener for securing the main runner to the second leg.

11. The grid system of claim 9 wherein the first leg of the clip comprises a third aperture configured to receive a fastener for securing the first cross tee to the first leg.

12. The grid system of claim 8 wherein the third leg of the clip is weakened proximate to the second leg so as to facilitate bending.

13. The grid system of claim 12 wherein the third leg of the clip is weakened by at least one notch.

14. The grid system of claim 13 the notch in the third leg of the clip is configured to receive an edge of the aperture in the web of the main runner.

15. A method for securing an unopposed cross tee to a main runner in a suspended ceiling grid system by means of a clip, the cross tee and the main runner both having a generally inverted T-shaped configuration with a vertical web interposed between opposed flanges and a strengthening bulb, the cross tee including a connector on at least one end thereof extending from the vertical web and the vertical web of the main runner including at least one generally vertical slot; and the clip comprising first leg, a second leg extending from, and generally perpendicularly to, the first leg, and a third leg extending from, and generally perpendicularly to, the second leg and generally parallel to the first leg so that the first, second and third legs define a generally U-shaped configuration for the clip, the method comprising:

extending the connector of the cross tee through the slot in the main runner, the cross tee being unopposed by a second cross tee;

extending the first leg of the clip through the slot in the main runner in a direction opposite to that of the connector on the cross tee so that the second leg of the clip lies along the web of the main runner;

extending the third leg of the clip through the aperture in the main runner;

bending the third leg of the clip so that it lies alongside the web of the main runner on a side opposite to that of the second leg; and securing at least one of the first leg and the second leg to the cross tee and main runner, respectively.

16. The method of claim 15 wherein the clip further comprises at least one of the first leg and the second leg having one or more apertures for facilitating securement of the first leg to the cross tee and the second leg to the main runner, and securing the clip to one or more of the cross tee and main runner by a fastener received in the aperture.

* * * * *